US007150674B2

(12) United States Patent
Okura

(10) Patent No.: US 7,150,674 B2
(45) Date of Patent: Dec. 19, 2006

(54) BOTH-SIDE GRINDING METHOD AND BOTH-SIDE GRINDING MACHINE FOR THIN DISC WORK

(75) Inventor: Kenji Okura, Yao (JP)

(73) Assignee: Koyo Machine Industries Co., Ltd., Osaka (JP)

( * ) Notice: Subject to any disclaimer, the term of this patent is extended or adjusted under 35 U.S.C. 154(b) by 0 days.

(21) Appl. No.: 10/530,722

(22) PCT Filed: Oct. 9, 2002

(86) PCT No.: PCT/JP02/10493

§ 371 (c)(1),
(2), (4) Date: Apr. 8, 2005

(87) PCT Pub. No.: WO2004/033148

PCT Pub. Date: Apr. 22, 2004

(65) Prior Publication Data

US 2006/0009125 A1 Jan. 12, 2006

(51) Int. Cl.
*B24B 49/04* (2006.01)

(52) U.S. Cl. ..... 451/8; 451/268; 451/397; 451/9; 451/262

(58) Field of Classification Search ..... 451/8, 451/9, 262, 264, 265, 268, 269
See application file for complete search history.

(56) References Cited

U.S. PATENT DOCUMENTS 5,816,895 A * 10/1998 Honda ..... 451/41
5,989,108 A * 11/1999 Ikeda et al. ..... 451/268
6,652,358 B1 * 11/2003 Ikeda et al. ..... 451/8
6,726,525 B1 * 4/2004 Kato et al. ..... 451/5
2003/0104698 A1 * 6/2003 Taniguchi et al. ..... 438/692
2003/0173017 A1 * 9/2003 Hecht et al. ..... 156/154

FOREIGN PATENT DOCUMENTS

JP 09262747 * 10/1997
JP 11-198009 A1 7/1999
JP 11-239956 * 9/1999
JP 11-239956 A1 9/1999
JP 2001-062718 A1 3/2001

OTHER PUBLICATIONS

PCT International Search Report for PCT/JP02/10493 mailed on Nov. 19, 2002.

* cited by examiner

*Primary Examiner*—Lee D. Wilson
*Assistant Examiner*—Robert Scruggs
(74) *Attorney, Agent, or Firm*—Rader, Fishman & Grauer PLLC

(57) ABSTRACT

Detecting the deviation of the grinding wheel position from the amount of work deformation after grinding, and correctly adjusting the grinding wheel position, it provides both-side grinding techniques for making the work excellent in flatness and parallelism. When the feeding operation of grinding wheels (1,2) is completed, the distances from hydrostatic pads (20, 21) to the surface and back of work (W) are measured at three points, and the deformation amount of work (W) is detected from the results of measurement at the three points by using air gauge sensors (Sa, Sb, Sc), and in case the calculated amount of deformation exceeds the specified value, the moving adjustment of grinding wheels (1, 2) is performed in accordance with the amount of deformation so that work (W) is flat without deformation when the feeding operation of grinding wheels (1, 2) is completed.

17 Claims, 11 Drawing Sheets

Sa, Sb, Sc
7
Air gauge sensor
Work deformation calculating unit
80
8
Comparator
8a
Correction calculator
8b
Axial position control unit
8c
Vertical position control unit
8d
Horizontal position control unit
8e
Stepping motor
Encoder
13
13a
13b
Stepping motor
Encoder
40
67
71
Stepping motor
Encoder
41
77
81

(a)

(b)

BOTH-SIDE GRINDING METHOD AND BOTH-SIDE GRINDING MACHINE FOR THIN DISC WORK

TECHNICAL FIELD

The present invention relates to a both-side grinding method and a both-side grinding machine for thin disc work, and more particularly, it relates to grinding techniques for simultaneously grinding the surface and back sides of a thin disc work such as a semiconductor wafer or the like by means of a pair of grinding wheels.

BACKGROUND ART

Conventionally, as a both-side grinding method for grinding the surface and back sides of such thin disc work (hereinafter called work), the one disclosed in Japanese Laid-open Patent H11-198009 is available.

In this grounding method, the work is disposed between a pair of cup type grinding wheels rotating at a high speed so that the outer periphery of the work intersects the outer periphery of the grinding surface of the grinding wheel and the center of the work is positioned within the annular grinding surface of the grinding wheel, and the work portion protruded radially outwardly from the outer periphery of the grinding surface is rotationally supported and also the pair of grinding wheels rotating at a high speed are fed in the axial direction of the grinding wheel spindle, then the surface and back sides of the work are held and simultaneously ground by the annular grinding surfaces of both grinding wheels.

And, a distance sensor is moved in the diametric direction of the work after grinding in order to measure the thickness of the work, and the parallelism of the work is enhanced by adjusting the tilt of the grinding wheel in accordance with the result of measurement.

Such a method is intended to obtain a work being high in parallelism of the machined surface by obtaining a work that is constant in thickness.

As the pair of grinding wheels repeat grinding operation, the grinding surface of each grinding wheel wears with the lapse of time, and there arises a difference in the amount of wear between the grinding surfaces of both grinding wheels. As a result, the positions of these grinding surfaces gradually become deviated from the predetermined initial or desired positions.

And, as in the conventional grinding method mentioned above, when the work portion protruded radially outwardly from between the pair of grinding wheels is rotationally supported and the work portion not supported is held and ground by both grinding wheels, if the grinding surface position is deviated from the desired position during grinding, then one of the grinding wheels will touch the work earlier, causing the work to be ground in a bent state. As a result, the work after grinding will be bent and there may arise a problem of its lowering in flatness and the like.

Also, even in case of defective tilt of the grinding wheel spindle due to secular change of component parts of the machine or external factors such as thermal displacement, the work will bend during grinding operation, and there arises a problem the same as mentioned above.

However, in the above grinding method, it is unable to detect the defective tilt of the grinding wheel spindle, and therefore, the problem of bending of the work result therefrom cannot be solved.

The present invention is intended to solve such a conventional problem, and the object of the invention is to provide a both-side grinding method in which the deviation of the grinding wheel caused by wear of the grinding surface of the grinding wheel or defective tilt of the grinding wheel spindle is detected from the amount of work deformation after grinding, and the position of the grinding wheel is correctly adjusted (to correct axial position and tilt), and thereby, work being free from bending and excellent in parallelism and flatness can be obtained.

Also, another object of the present invention is to provide a both-side grinding machine having a configuration that enables the execution of the both-side grinding method.

DISCLOSURE OF THE INVENTION

In order to achieve the above purpose, the grinding method of the present invention is a grinding method in which a thin disc work is rotationally supported and a pair of grinding wheels rotating at a high speed is fed in the axial direction of the grinding wheel spindle in order to simultaneously grind both surface and back sides of the work by the grinding surfaces of the grinding wheels, comprising the steps of measuring respective distances from the predetermined position to both surface and back of the work at three points at least by using a non-contact type distance sensor when the feeding operation of the grinding wheels is completed; detecting the amount of deformation of the work from the results of measurement at the three points at least; and in case the calculated amount of deformation exceeds the specified value, adjusting the grinding wheels in accordance with the amount of deformation so that the work is flat without deformation when the feeding operation of the grinding wheels is completed.

As a preferable embodiment of operation, for the rotational support of the work, in a state that the work is disposed so that the outer periphery of the work intersects the outer periphery of the grinding surface of the grinding wheel as viewed opposite to the surface and back of the work, the work surface and back portions protruded radially outwardly from the outer periphery of the grinding surface are rotationally supported Also, the grinding machine of the present invention is designed to execute the grinding method in which a thin disc work is rotationally supported and a pair of grinding wheels rotating at a high speed are fed in the axial direction of the grinding wheel spindle in order to simultaneously grind both the surface and back sides of the work by the grinding surfaces of the grinding wheels, comprising a pair of grinding wheels disposed so that the grinding surfaces at the ends are opposed to each other, a work supporting means which rotationally supports the work in a state that the surface and back of the work are opposed to both grinding surfaces between the grinding surfaces of the pair of grinding wheels, a grinding wheel adjusting means for adjusting the position of the grinding wheel, a work measuring means which measures the distances from the predetermined reference position to the surface and back of the work rotationally supported by the work supporting means at three points at least when the feeding operation of the grinding wheels is completed and calculates the amount of deformation of the work in a state of being rotationally supported from the results of measurement at the three points, and a wheel position control means for controlling the grinding wheel adjusting means in accordance with the measurement results of the work measuring means.

As a preferable embodiment of operation, the work supporting means is configured in that in a state that the work is disposed so that the outer periphery of the work intersects the outer periphery of the grinding surface of the grinding wheel as viewed opposite to the surface and back of the work, the work surface and back portions protruded radially outwardly from the outer periphery of the grinding surface are rotationally supported, and preferably, the work supporting means comprises a hydrostatic supporting means which supports the surface and back sides of the work with hydrostatic fluid in a non-contact state.

Also, the work measuring means comprises at least three pairs of non-contact type distance sensors for measuring the distances from the predetermined reference position to the surface and back of the work, and a work deformation calculating means for calculating the amount of deformation of the work from the detection results of these three pairs of distance sensors.

Further, the grinding wheel adjusting means comprises an axial position adjusting means for adjusting the axial position of the grinding wheel, a vertical position adjusting means for vertically adjusting the tilt of the grinding wheel about the horizontal axis, and a horizontal position adjusting means for horizontally adjusting the tilt of the grinding wheel about the vertical axis, wherein the wheel position control means is configured in that when the amount of deformation of the work measured by the work measuring means exceeds the specified value, the axial position adjusting means, vertical position adjusting means, and horizontal position adjusting means of the grinding wheel adjusting means are controlled in accordance with the measured amount of deformation so that the work is flat without deformation when the feeding operation of the grinding wheels is completed.

In the present invention, the work is rotationally supported and a pair of grinding wheels rotating at a high speed are fed in the axial direction of the grinding wheel spindle in order to simultaneously grind the surface and back sides of the work with the grinding surfaces of both grinding wheels.

In this case, when the feeding operation of the grinding wheel is completed, the respective distances from the specified reference position to the surface and back of the work are measured at three points at least by using a non-contact type distance sensor, and the amount of deformation of the work is detected from the results of measurement at three points at least. Also, in case the calculated amount of deformation exceeds the specified value, the grinding wheel is adjusted in accordance with the amount of deformation so that the work is flat without deformation when the feeding operation of the grinding wheel is completed, and thereby, it is possible to keep the grinding wheels in correct positions (correct axial direction and tilt) and to obtain work being free from bending and excellent in parallelism and flatness.

BRIEF DESCRIPTION OF THE DRAWINGS

FIG. 11(*a*) is a front view, and FIG. 11(*b*) is a partly sectional plan view.

DETAILED DESCRIPTION OF THE PREFERRED EMBODIMENTS

The preferred embodiments of the present invention will be described in the following with reference to the drawings.

The grinding machine of the present invention is shown in FIG. 1 to FIG. 11. Specifically, this grinding machine is a horizontal type opposed double-disk surface grinding machine which is used for simultaneous grinding of the surface and back of a semiconductor wafer that is work W, wherein spindles 3, 4 of paired grinding wheels 1, 2 horizontally opposing to each other are rotationally supported.

Figure 1:
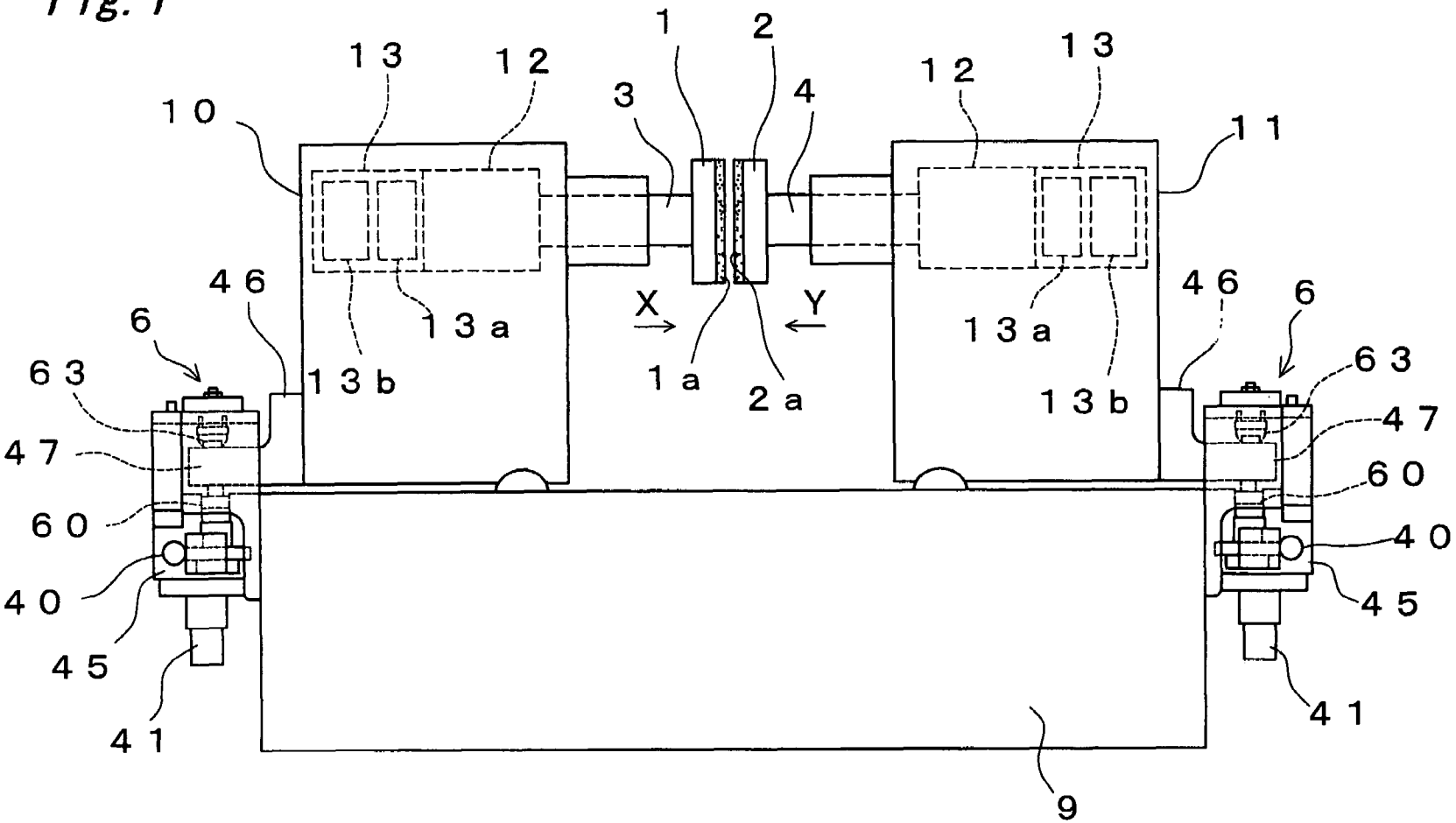
FIG. 1 is a front view of an opposed double-disk surface grinding machine in one preferred embodiment of the present invention.

This grinding machine comprises, as shown in FIG. 1, right and left paired grinding wheels 1, 2, work supporting device 5, etc., which are main components of the grinding section, as a basic configuration. Also, it comprises grinding wheel tilting device 6 for adjusting and keeping grinding wheels 1, 2 in correct positions, work measuring device (work measuring means) 7, and wheel position control device (wheel position control means) 8, and these are disposed on horizontal bed 9 which forms a stationary section.

Specifically, grinding wheels 1, 2 are cup type grinding wheels, of which the peripheral end surfaces 1*a*, 2*a* are annular grinding surfaces. These grinding wheels 1, 2 are arranged so that grinding surfaces 1*a*, 2*a* are opposed to each other in nearly parallel state, and at the grinding position between these grinding surfaces 1*a*, 2*a*, the work W is rotationally supported by work supporting device 5 as described later.

Specifically, grinding wheels 1, 2 are detachably fixed at the end portions of spindles 3, 4 rotatably supported by wheel spindle stocks 10, 11. These grinding wheel spindles 3, 4 make driving connection with rotational drive sources 12 such as drive motors installed in wheel spindle stocks 10, 11, and are operated to move in the axial direction or grinding directions X, Y respectively by means of wheel feeding devices 13 installed in wheel spindle stocks 10, 11.

The wheel feeding device 13 originally functions to operate the grinding wheel 1, 2, and also, as described later, it configures a grinding wheel adjusting means for adjusting the position of grinding wheel 1, 2 together with the wheel tilting device 6, and specifically, functions as an axial position adjusting means for adjusting the axial position of grinding wheel 1, 2.

The specific structure of wheel feeding device 13 is not shown, but for example, it comprises a ball screw mechanism and stepping motor 13*a* for driving the ball screw mechanism as its main components, and absolute value encoder 13*b* is connected to the output shaft of the stepping motor 13*a*, the same as for stepping motor 67, 77 of the wheel tilting device 6 described later.

The right and left wheel spindle stocks 10, 11 are tiltably mounted on top surface of bed 9.

That is, although the detail is not shown, the front portion 15 of wheel spindle stocks 10, 11 are pivoted on bed 9 via a vertical support shaft and a horizontal support shaft not shown, and thereby, wheel spindle blocks 10, 11 are able to tilt in a horizontal direction (vertical to the space of FIG. 1) about the vertical support shaft (vertical axis) and in a vertical direction (horizontal to the space of FIG. 1) about the horizontal support shaft (horizontal axis). Also, the side portion of wheel spindle stocks 10, 11 are respectively connected to bed 9 via the wheel tilting devices 6, 6. The wheel tilting device 6 forms a grinding wheel adjusting means for adjusting the position of grinding wheel 1, 2 together with wheel feeding device 13, and the specific structure will be described later.

Work supporting device 5 functions as a work supporting means for rotationally supporting the work W, which is configured in that work W is rotationally supported between grinding surfaces 1*a*, 2*a* of paired grinding wheels 1, 2 in a vertical state such that the surface and back Wa, Wb thereof are opposed to the grinding surfaces 1*a*, 2*a*.

Figure 2:
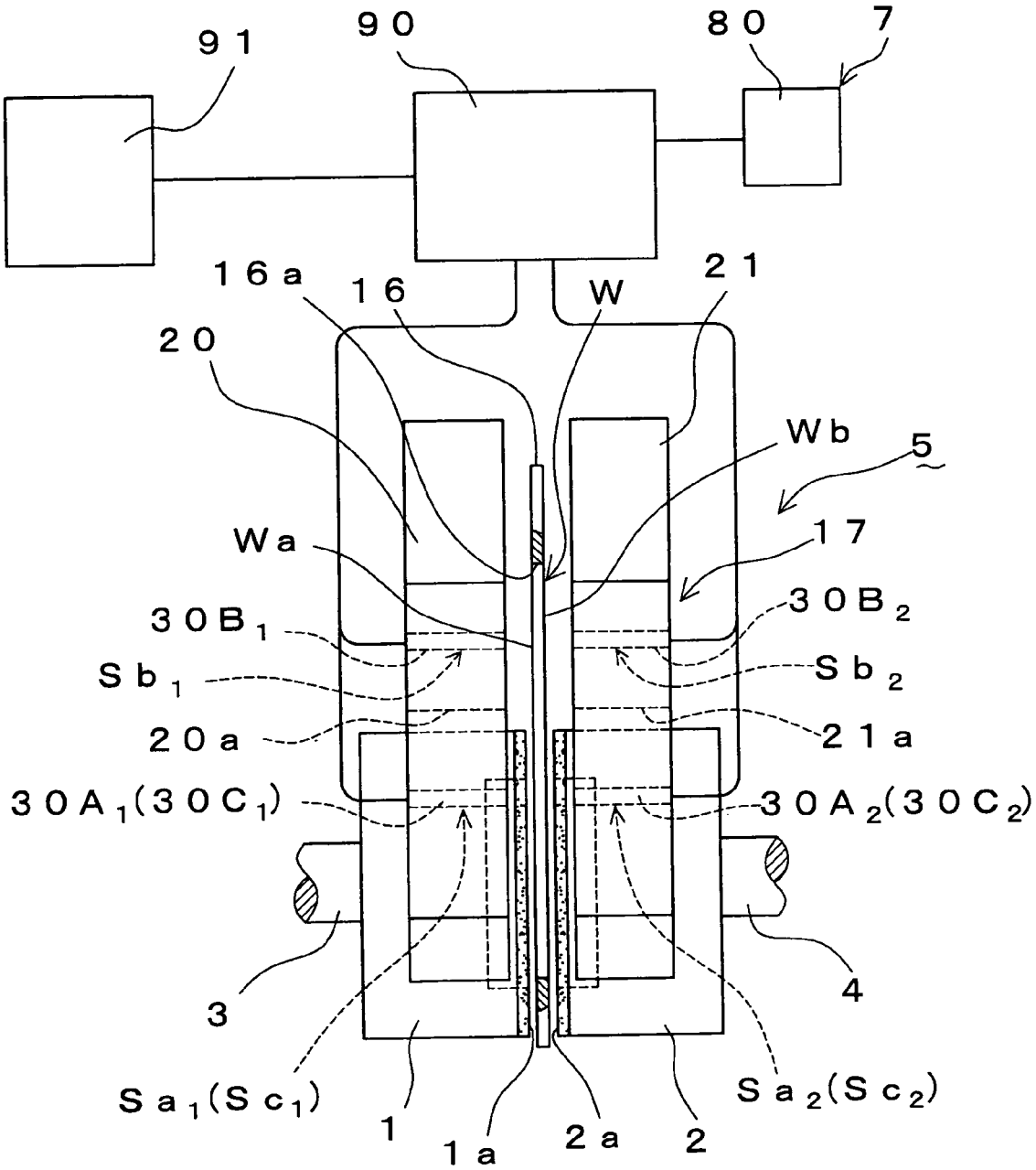
FIG. 2 is a front view of a grinding wheel and work supporting device of the surface grinding machine.
Figure 3:
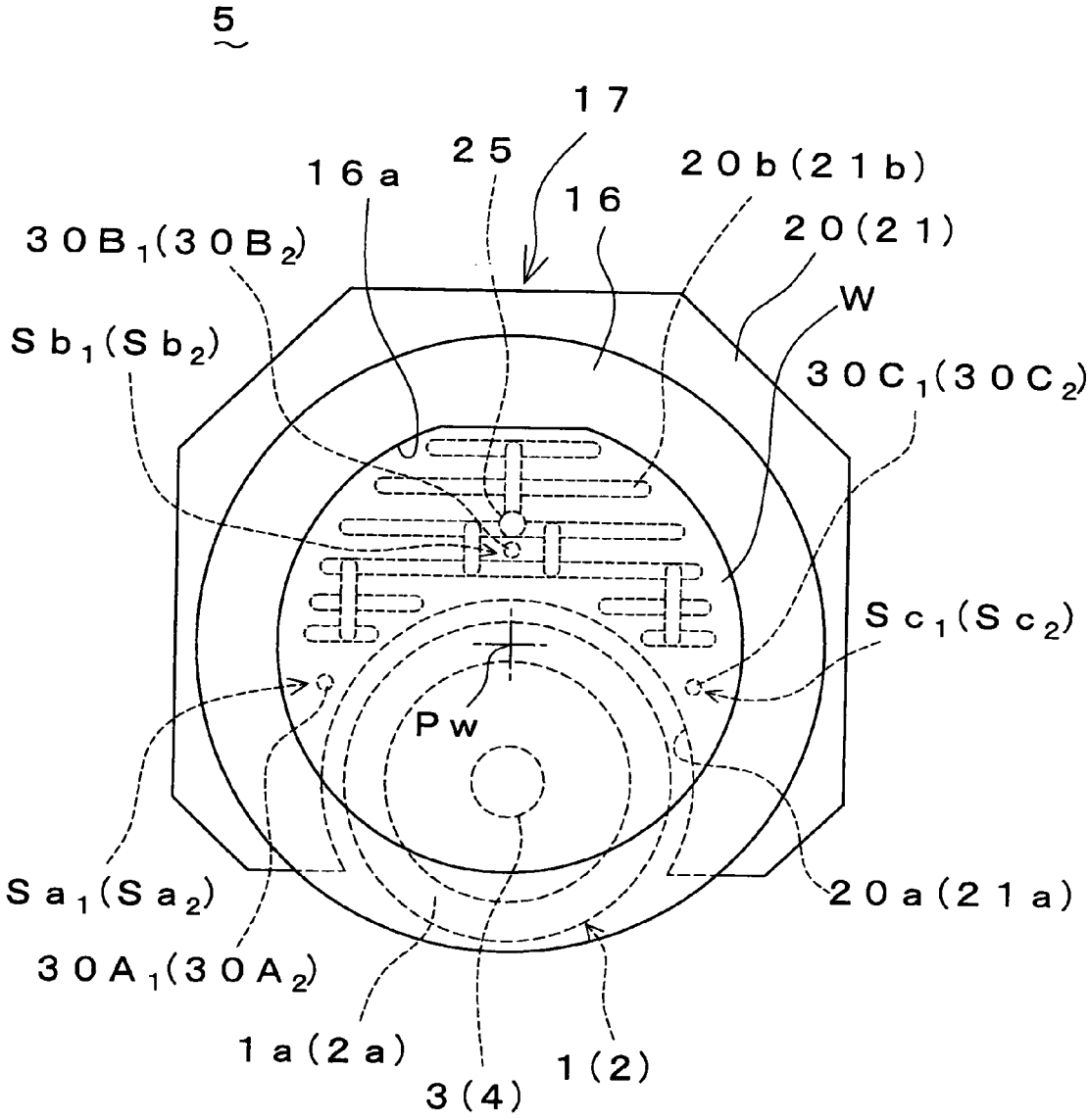
FIG. 3 is a side view of the grinding wheel and work supporting device.

Specifically, the work supporting device 5 is, as shown in FIG. 2 and FIG. 3, structurally such that the outer periphery of work W intersects the outer peripheries of grinding surfaces 1*a*, 2*a* of grinding wheels 1, 2, and the center Pw of work W is positioned within the grinding surfaces 1*a*, 2*a*, and in this condition, the portions protruded radially outwardly from the outer peripheries of grinding surfaces 1*a*, 2*a* of surface and back Wa, Wb of work W are rotationally supported.

The work supporting device 5 comprises an axial support means for positioning and supporting the work W in axial direction and a radial support means for positioning and rotationally supporting the work W in radial direction, and work W is rotationally supported by the work supporting device 5 in a state that the outer periphery of the work W is fitted and supported in support hole 16a of support carrier 16.

The axial support means includes hydrostatic support device (hydrostatic support means) 17 which supports the surface and back Wa, Wb of work W with hydrostatic fluid in non-contact state, and as its main component, it comprises right and left paired hydrostatic pads 20, 21 opposing to each other.

Specifically, these hydrostatic pads 20, 21 are vertical thick plates provided with notches 20*a*, 21*a* for avoiding interference with grinding wheels 1, 2, and as shown in FIG. 3, notches 20*a*, 21*a* have an arcuate bore profile whose diameter is a little larger than that of grinding wheel 1, 2 and their opposed support surfaces are respectively provided with hydrostatic grooves 20*b*, 21*b*.

Hydrostatic grooves 20*b*, 21*b* are connected to a liquid source (not shown) via fluid feed hole 25, and pressure fluid such as water supplied from the fluid source is spouted from the hydrostatic grooves 20*b*, 21*b*, thereby statically maintaining the surface and back Wa, Wb of work W outwardly protruded from between the grinding surfaces 1*a*, 2*a* of grinding wheels 1, 2 in a non-contacting state nearly at an axial center position between the grinding surfaces 1*a*, 2*a* of both grinding wheels 1, 2.

Also, at the opposed support surfaces of hydrostatic pads 20, 21, three air nozzles 30A, 30B, 30C of work measuring device 7 are formed in the vicinity of grinding wheels 1, 2, forming a distance sensor section described later.

Although the radial support means of work supporting device 5 is not specifically shown, a commonly-known rotary driving device is employed. The rotary driving device comprises, for example, a plurality of support rollers for abutting and supporting the outer periphery of support carrier 16 which supports work W, and a rotary driving source such as a drive motor which rotationally drives some or all of these support rollers, and work W is rotated in a state of being positioned and supported in radial direction. In the embodiment shown, as in FIG. 3, work W is positioned and rotationally supported so that the center of work W and the center of grinding surfaces 1*a*, 2*a* of both grinding wheels 1, 2 are positioned on same vertical line.

Grinding wheel tilting device 6, as described above, comprises a grinding wheel adjusting means for adjusting the positions of the grinding wheels 1, 2 together with wheel feeding device 13 as an axial position adjusting means. Specifically, grinding wheel tilting device 6 comprises vertical position adjusting member (vertical position adjusting means) 40 for vertically tilting and adjusting the grinding wheels 1, 2 about the horizontal axis and horizontal position adjusting member (horizontal position adjusting means) 41 for horizontally tilting and adjusting the grinding wheels 1, 2 about the vertical axis. An example of grinding wheel tilting device 6 for right-hand wheel spindle stock 11 will be described in the following.

Figure 5:
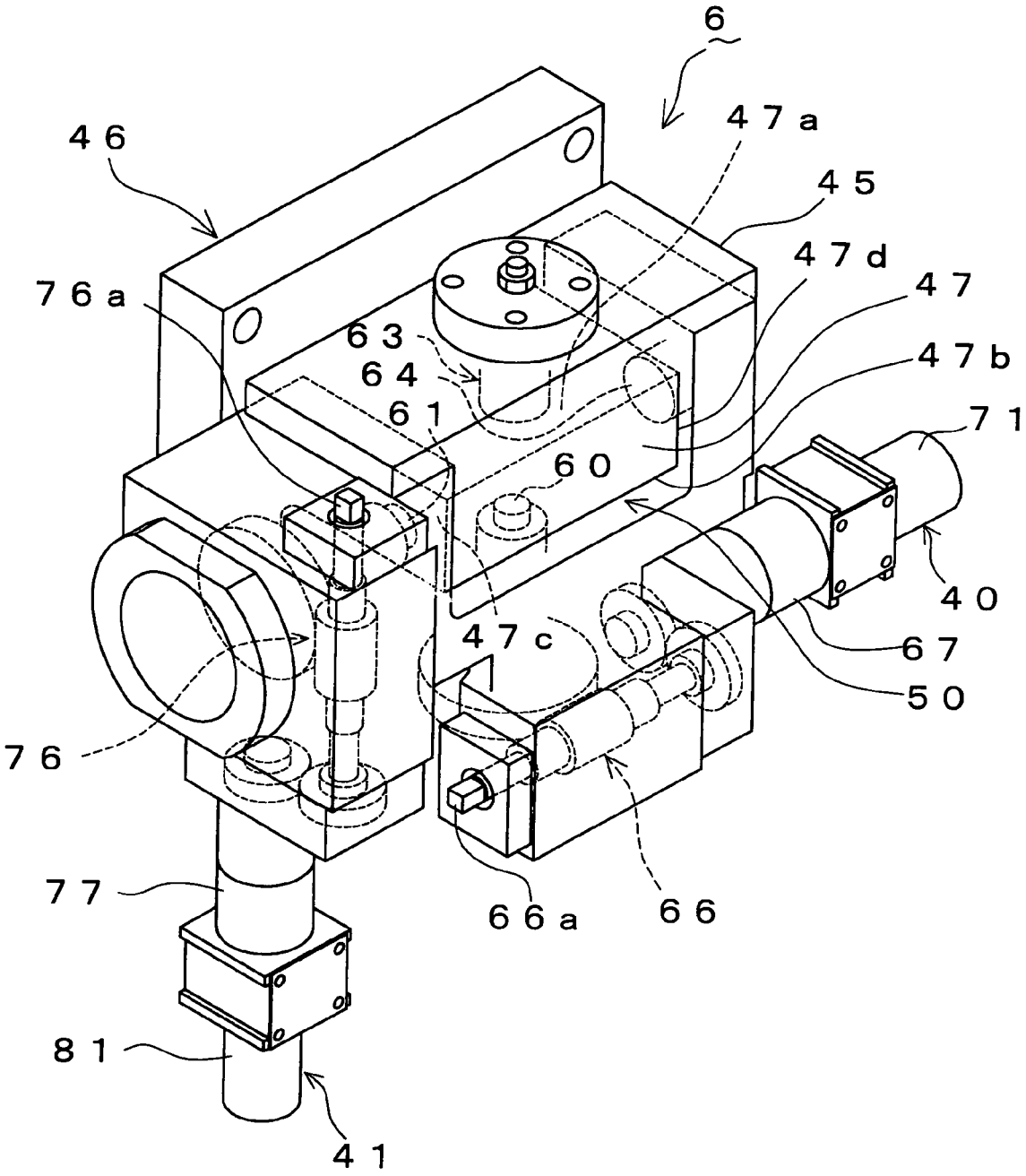
FIG. 5 is a perspective view of a grinding wheel tilting device at the right-hand side of FIG. 1.
Figure 6:
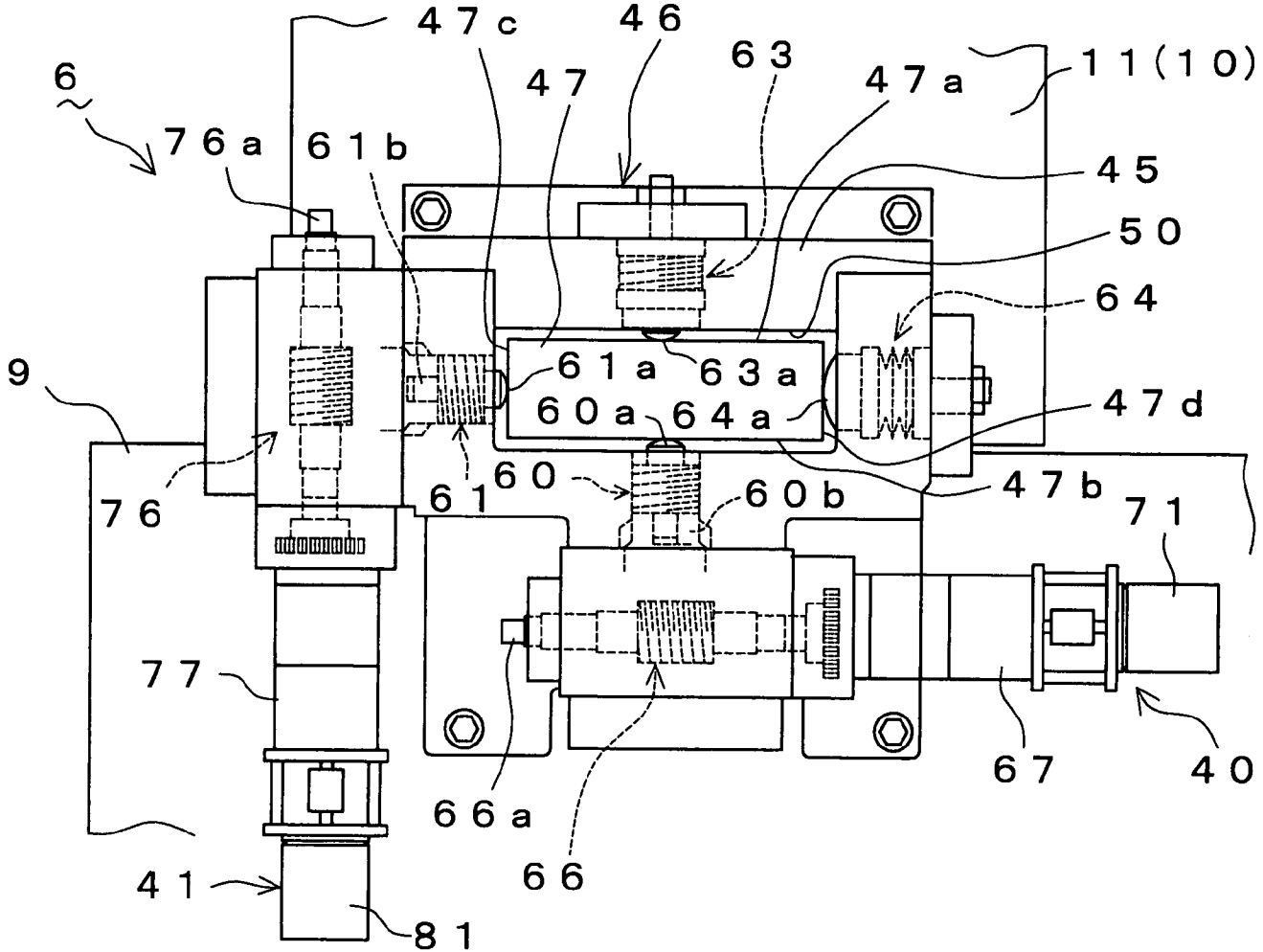
FIG. 6 is a right-hand side view of the grinding wheel tilting device.

Grinding wheel tilting device 6 shown is specifically as shown in FIG. 5 and FIG. 6 configured in that the vertical position adjusting member 40 and the horizontal position adjusting unit 41 are mounted on driving main body 45 secured on bed 9 that is the stationary side, and driven body 46 which is adjusted by these adjusting members 40, 41 is secured on wheel spindle stock 10, 11 that is the tilting side.

Driving main body 45 is fixed on the side end of bed 9 and protruded upward from the bed 9, where there is provided storing space 50 with a rectangular cross-section therethrough in horizontal direction to the right and left. Adjusting screw 60 of vertical position adjusting member 40 and adjusting screw 61 of horizontal adjusting unit 41 are respectively thrust into the storing space 50.

Driven body 46 is fixed on the side end of wheel spindle stock 11, and driven member 47 extending in horizontal direction thrusts into the storing space 50 of driving main body 45 to abut and engage the adjusting screws 60, 61 of both adjusting members 40, 41.

That is, driven member 47 has a rectangular cross-section as shown in FIG. 6, and for moving adjustment in vertical direction, engaging end 60*a* of adjusting screw 60 of vertical position adjusting member 40 abuts the horizontal bottom 47*b*, and also, engaging end 63*a* of resilient member 63 disposed in driving main body 45 resiliently abuts the horizontal top 47*a*. Thus, adjusting screw 60 and driven member 47 structurally abuts and engages each other in vertical direction at all times.

On the other hand, for moving adjustment in horizontal direction, engaging end 61*a* of adjusting screw 61 of vertical position adjusting unit 41 abuts one vertical surface 47*c* of driven member 47, and also, engaging end 64*a* of resilient member 64 formed of a coned disc spring or the like disposed opposite to adjusting screw 61 in driving main body 45 resiliently abuts the other vertical surface 47*d*. Thus, adjusting screw 61 and driven member 47 structurally abuts and engages each other in horizontal direction at all times.

Adjusting screw 60 of vertical position adjusting member 40 is, as shown in FIG. 6, disposed vertically threadably into internal thread 65 of driving main body 45, and its end is engaging end 60*a*, and its base end 60*b* makes driving connection with stepping motor 67 via worm gear 66.

Thus, the rotation of the output shaft of stepping motor 67 is transmitted to adjusting screw 60 via worm gear 66, and in this way, adjusting screw 60 is vertically screwed in and out, thereby causing the driven body 46 to follow the movement of adjusting screw 60 and to move in vertical direction. As a result, wheel spindle stock 11 is vertically tilted about the horizontal axis, and the tilt of grinding wheel 2 is adjusted.

And, when stepping motor 67 stops operating, adjusting screw 60 stops moving, then driven body 46 stops in a state of being held between adjusting screw 60 and pressing member 32, and wheel spindle stock 11 is positioned and secured vertically as specified. Also, the absolute value of rotating position of stepping motor 67 is always detected by encoder 71.

Adjusting screw 61 of horizontal position adjusting unit 41 is, as shown in FIG. 6, disposed horizontally threadably into driving main body 45, and its end is engaging end 61*a*, and its base end 61*b* makes driving connection with stepping motor 77 via worm gear 76.

Thus, the rotation of the output shaft of stepping motor 77 is transmitted to adjusting screw 61 via worm gear 76, and in this way, adjusting screw 61 is horizontally screwed in and out, thereby causing the driven body 46 to follow the movement of adjusting screw 61 and to move in horizontal direction. As a result, wheel spindle stock 11 is horizontally tilted about the vertical axis, and thereby, the tilt of grinding wheel 2 is adjusted.

And, when stepping motor 77 stops operating, adjusting screw 61 stops moving, then driven body 46 stops in a state of being held between adjusting screw 61 and pressing member 64, and wheel spindle stock 11 is positioned and secured horizontally as specified. Also, the absolute value of rotating position of stepping motor 77 is always detected by encoder 81.

When the tilt of grinding wheel 2 is not adjusted, power supply to stepping motors 67, 77 of vertical and horizontal position adjusting members 40, 41 is stopped, and the output shafts of stepping motors 67, 77 are kept in a state of being free. In this way, when each stepping motor 67, 77 is in stop mode, adjusting screw 60, 61 is also in stop mode as described above, and driven body 47 is held between adjusting screw 60, 61 and resilient member 63, 64 and secured against driving main body 45. Therefore, wheel spindle stock 11 is secured in a specified position against bed 9.

Work measuring device (work measuring means) 7 serves to measure the amount of deformation of work W during grinding operation, and specifically, when the feeding operation of grinding wheels 1, 2 is completed, the distances from the reference position to the surface and back Wa, Wb of work W rotationally supported by work supporting device 5 are measured at three points at least, and from the results of measurement at these three points, the amount of deformation of work W is calculated, and the configuration includes a plurality (three in the case of the embodiment shown) of air gauge sensors Sa, Sb, Sc and work deformation calculating unit (work deformation calculating means) 80 as its main components.

Distance sensors Sa, Sb, Sc are non-contact type sensors, and in the embodiment shown, air gauge sensors using air pressure as measuring medium are employed. These air gauge sensors Sa, Sb, Sc comprise air nozzles 30A, 30B, 30C, and as described above, these air nozzles 30A, 30B, 30C are disposed over the opposed supporting surfaces of hydrostatic pads 20, 21 of work supporting device 5.

That is, these air nozzles 30A, 30B, 30C of air gauge sensors Sa, Sb, Sc are disposed one pair each, six nozzles in total, in opposing positions of the opposed supporting surfaces of hydrostatic pads 20, 21 with work W therebetween as shown in FIG. 2 and FIG. 3.

Figure 4:
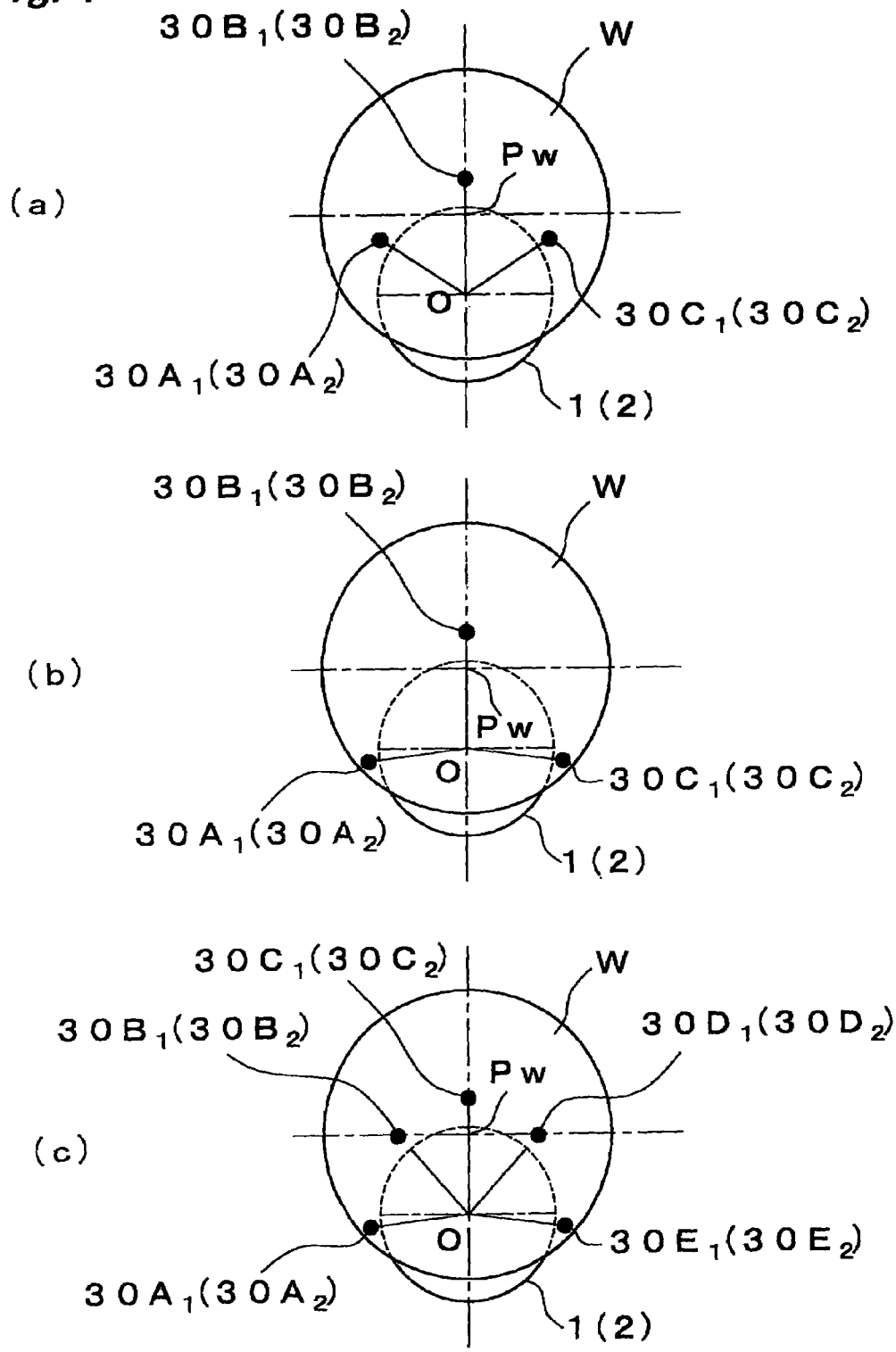
FIG. 4, consisting of FIGS. 4(*a*) to 4(*c*), is a schematic diagram showing the arrangement of an air nozzle of an air gauge sensor as viewed opposite to the surface and back of work.

The sets (3 sets) of the paired air nozzles $\mathbf{30}A_1$ and $\mathbf{30}A_2$, $\mathbf{30}B_1$ and $\mathbf{30}B_2$, $\mathbf{30}C_1$ and $\mathbf{30}C_2$ are, as shown in FIG. 3 and FIG. 4, disposed in positions as close to the outer peripheries of grinding surfaces 1*a*, 2*a* as possible in the vicinity of outer peripheries of grinding surfaces 1*a*, 2*a* of grinding wheels 1, 2 as viewed opposite to surface and back Wa, Wb of work W.

Specifically, as shown in FIG. 4 (*a*), one set of the air nozzles of the air gauge sensor, that is, the set of air nozzles $\mathbf{30}B_1$, $\mathbf{30}B_2$ is arranged so as to be positioned on the vertical center line, a diametric line, of work W (and grinding wheels 1, 2), and also, the remaining air nozzle sets, that is, the set of air nozzles $\mathbf{30}A_1$, $\mathbf{30}A_2$ and the set of air nozzles $\mathbf{30}C_1$, $\mathbf{30}C_2$ are arranged in positions symmetrical to the vertical center line, and these sets of air nozzles are arranged at equal intervals [angles (central angles) of each nozzle to the center of grinding wheels 1, 2 are uniform] along the circumference of the grinding surfaces 1*a*, 2*a* of grinding wheels 1, 2.

Further, if the space permits, the set of air nozzles $\mathbf{30}A_1$, $\mathbf{30}A_2$ and the set of air nozzles $\mathbf{30}C_1$, $\mathbf{30}C_2$ are, in addition to the above conditions, desirable to be arranged close to the outer periphery of work W, as shown in FIG. 4 (*b*).

And, these air nozzles $\mathbf{30}A_1$ and $\mathbf{30}A_2$, $\mathbf{30}B_1$ and $\mathbf{30}B_2$, $\mathbf{30}C_1$ and $\mathbf{30}C_2$ are connected to air source 91 via A/E converter (air pressure/electric signal converter) 90. Also, A/E converter 90 is connected to work deformation calculating unit 80.

In FIG. 2, air nozzles $\mathbf{30}A_1$, $\mathbf{30}B_1$, $\mathbf{30}C_1$ of left-hand hydrostatic pad 20 are provided for measuring distances $La_1$, $Lb_1$, $Lc_1$ between the left-hand surface of work W supported by work supporting device 5 and the supporting surface side of left-hand hydrostatic pad 20 that is the reference position, and air nozzles $\mathbf{30}A_2$, $\mathbf{30}B_2$, $\mathbf{30}C_2$ of right-hand hydrostatic pad 21 are provided for measuring distances $La_2$, $Lb_2$, $Lc_2$ between the right-hand back side of work W supported by work supporting device 5 and the supporting surface of right-hand hydrostatic pad 21 that is the reference position. That is, the pressure at the outlet port of each air nozzle has a constant relation with the distance.

The pressure at the outlet port of each air nozzle 30A ($\mathbf{30}A_1$, $\mathbf{30}A_2$), 30B ($\mathbf{30}B_1$, $\mathbf{30}B_2$), and 30C ($\mathbf{30}C_1$, $\mathbf{30}C_2$) is converted into electric signal by A/E converter 90 and transmitted to work deformation calculating unit 80.

Work deformation calculating unit 80 calculates the amount of deformation of work W from the results detected by three sets of air gauge sensors $Sa_1$ and $Sa_2$, $Sb_1$ and $Sb_2$, $Sc_1$ and $Sc_2$, where distances La ($La_1$, $La_2$), Lb ($Lb_1$, $Lb_2$), and Lc ($Lc_1$, $Lc_2$) from the opposed supporting surfaces of hydrostatic pads 20, 21 to work W are respectively measured in accordance with the air pressures at the outlet ports of air nozzles 30A ($\mathbf{30}A_1$, $\mathbf{30}A_2$), 30B ($\mathbf{30}B_1$, $\mathbf{30}B_2$), and 30C ($\mathbf{30}C_1$, $\mathbf{30}C_2$), and also, the amount of deformation of work W is calculated from the distances measured at three points, and the results are transmitted to wheel position control device 8.

For the control based on the detection results of air gauge sensors Sa ($Sa_1$, $Sa_2$), Sb ($Sb_1$, $Sb_2$), and Sc ($Sc_1$, $Sc_2$) in wheel position control device 8, the value obtained by dividing the difference in measured value between the sets of air gauge sensors by 2, that is, distance value $La=(La_1-La_2)/2$, distance value $Lb=(Lb_1-Lb_2)/2$, and distance value $=(Lc_1-Lc_2)/2$ are treated as the amounts of deformation.

Figure 7:
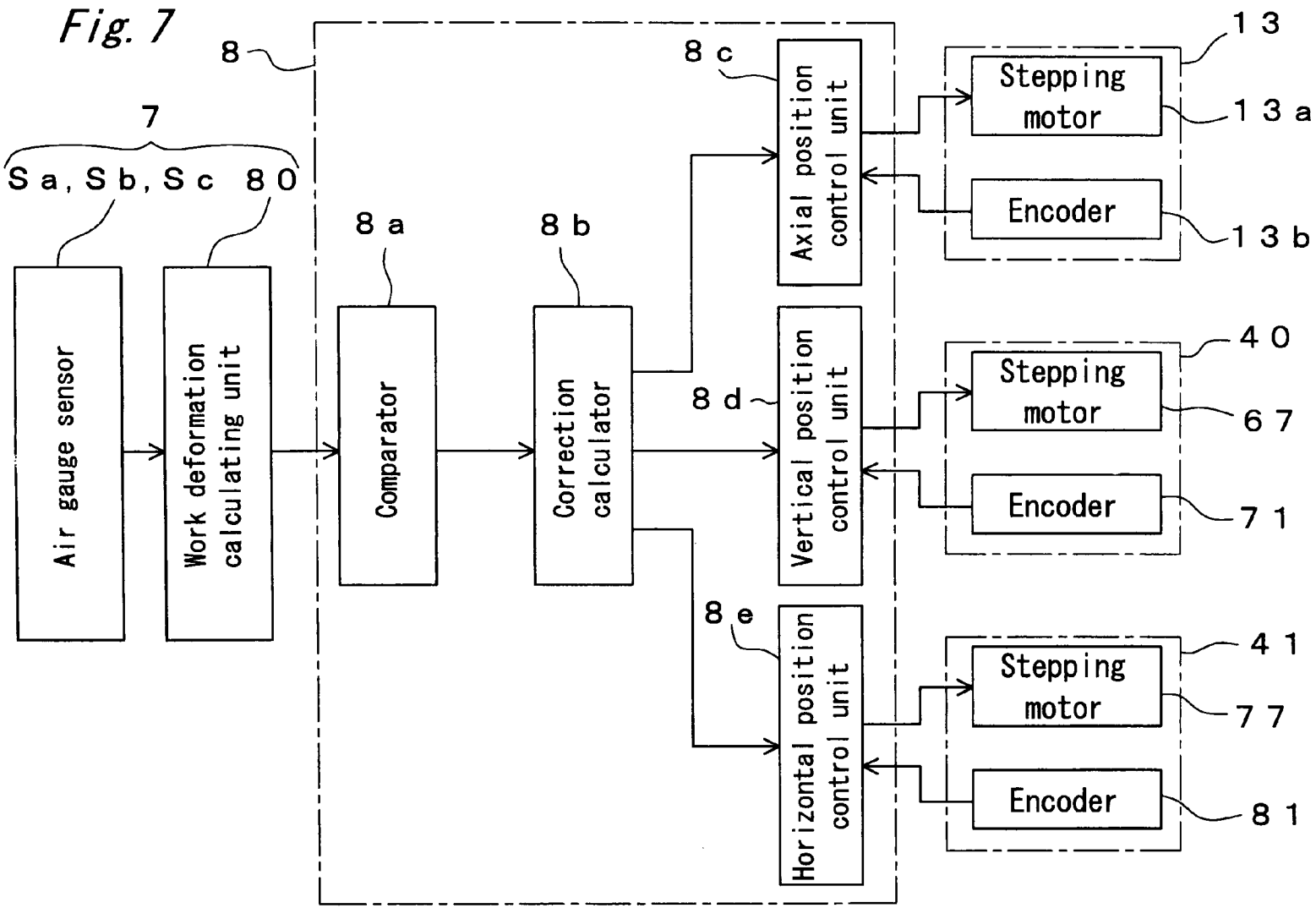
FIG. 7 is a block diagram showing the configuration of a work measuring device and wheel position control device of the surface grinding machine.

Wheel position control device 8 serves to control the wheel position adjusting device, that is, wheel tilting device 6 as a vertical and horizontal position adjusting means, and wheel feeding device 13 as an axial position adjusting means, in accordance with the measurement results of work measuring device 7. As shown in FIG. 7, the control device comprises comparator 8*a*, correcting calculator 8*b*, and axial position control unit 8*c*, vertical position control unit 8*d*, and horizontal position control unit 8*e*.

Comparator 8*a* compares the amounts of deformation (distance values) La, Lb, Lc of work W measured by work measuring device 7 with specified tolerance (threshold value) Ls and judges whether or not it exceeds the threshold value Ls, and transmits the result of judgment to correcting calculator 8*b*. In accordance with the result of judgment of comparator 8*a*, correcting calculator 8*b* calculates the amount of vertical, horizontal and axial position corrections (adjustment direction and amount) of grinding wheels 1, 2 in accordance with the amount of deformation La, Lb, Lc when the amount of deformation La, Lb, Lc of work W exceeds the threshold value Ls, and the results of calculation are transmitted to axial position control unit 8*c*, vertical position control unit 8*d* and horizontal position control unit 8*e*. These control units 8*c* to 8*e* decide the rotating direction and rotating amount of stepping motors 67, 77 of grinding wheel tilting device 6 and stepping motor 13*a* of wheel feeding device 13 in accordance with the calculation results of correcting calculator 8*b*, and while feeding back the outputs of encoders 13*b*, 71 and 81, the units rotationally drive the stepping motors 13*a*, 67, 77 by the decided amount in the decided direction. In this way, the axial positions of grinding wheel spindles 3, 4 on wheel spindle stocks 10, 11 and the vertical horizontal tilting of wheel spindle stocks 10, 11 are adjusted, and the positions of grinding wheels 1, 2 are moved and adjusted so that grinding wheels 1, 2 are in correct positions, that is, work W is flat without deformation when the feeding operation of grinding wheels 1, 2 is completed.

The position adjustment of grinding wheels 1, 2 in the grinding machine of the present embodiment will be specifically described in the following with reference to FIG. 8 to FIG. 11. In FIG. 8 to FIG. 11, for the purpose of easier understanding, grinding wheels 1, 2 and the deformation amount of work W are schematically shown and greatly enlarged in the drawing, but actually, the amount of deformation is very fine and cannot be visually observed.

A. Grinding Wheel 1, 2 Feeding Operation:

In this embodiment, the grinding wheel 1, 2 feeding operation being the basic operation of grinding is controlled by a main control unit, not shown but commonly known, in such manner that the position of completing the grinding wheel 1, 2 feeding operation is controlled and the deformation amount of work W is less than the specified amount.

That is, paired grinding wheels 1, 2 are fed by wheel feeding device 13 from the specified standby position (feeding start position) by a predetermined feeding amount (fixed amount) and then stopped (the stop position is the position of completing the feeding operation), which are returned to the standby position after spark-out. In this one cycle of grinding, a sheet of work W is ground to be machined to the specified thickness, and this cycle of grinding is continuously repeated for each work sequentially supplied. Also, the position of completing the feeding operation is controlled by feeding back the detection data to wheel feeding device 13 with use of an in-process sizing device not shown.

Figure 8:
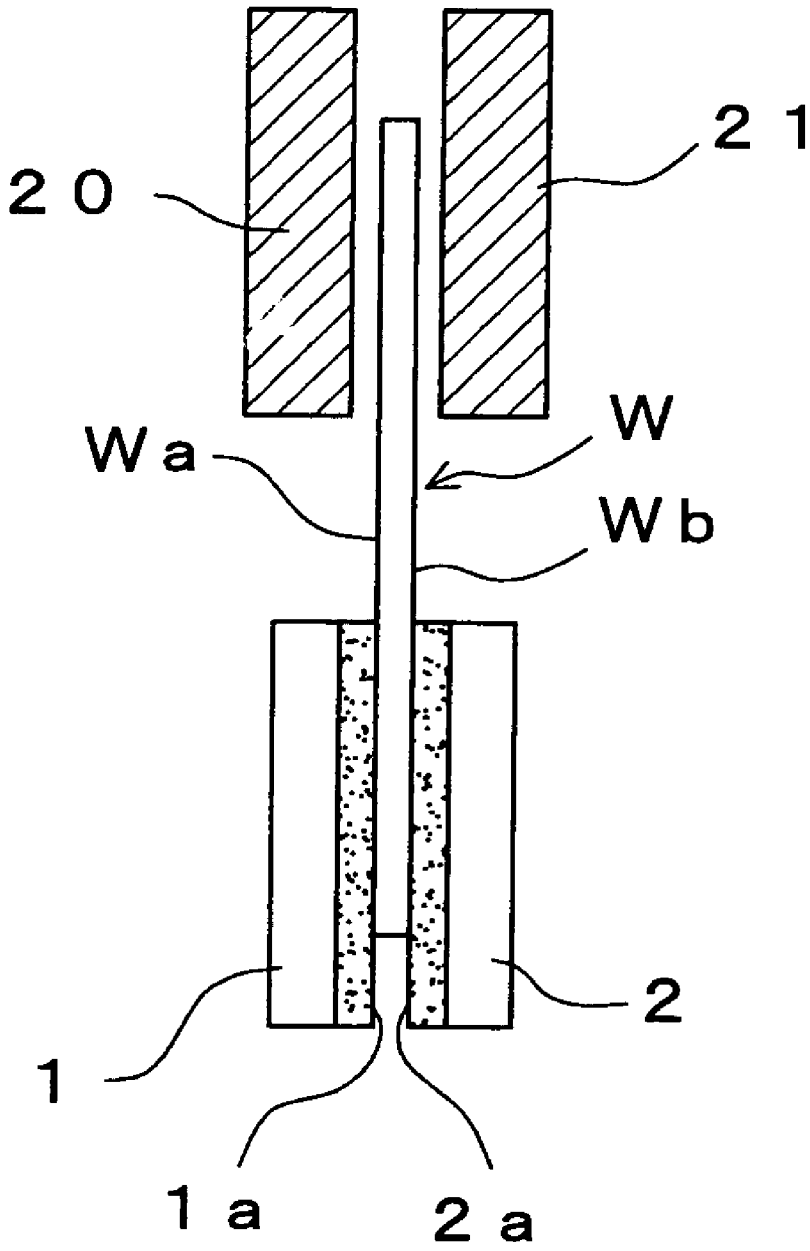
FIG. 8 is a schematic diagram showing the positional relation between the work supported by hydrostatic pad of the surface grinding machine and the grinding wheel of the surface grinding machine, showing the initial state.

B. Initial State Adjustment:

In the grinding machine of this embodiment which executes such a cycle of grinding, the machine is first adjusted to a state such that grinding wheels 1, 2, hydrostatic pads 20, 21, and work W are in parallel and aligned to each other, that is, the initial state shown in FIG. 8. In this initial state, the grinding surfaces 1*a*, 2*a* of right and left paired grinding wheels 1, 2 are parallel with each other, and the supporting surfaces of right and left paired hydrostatic pads 20, 21 are parallel with each other, and work W is ready to be ground with specified accuracy (parallelism, flatness). In this condition, the distance value La=Lb=Lc between work W and hydrostatic pad 20, 21. The value in this initial state is ideal distance value $L_0$.

Specifically, the position (feed completing position) of grinding surfaces 1*a*, 2*a* of grinding wheels 1, 2 at which the deformation amount of work W becomes 0 when the grinding wheel feeding is completed, then the position is determined as optimum position. And, in accordance with the optimum position and the deformation amount of each work W on completion of grinding, the standby position (wheel feeding start position) of grinding wheels 1, 2 is adjusted and the feed completing position of grinding surfaces 1*a*, 2*a* of grinding wheels 1, 2 is adjusted so as not to be deviated more than specified value from the optimum value.

The optimum position is determined as follows. A plurality of work W are prepared. Subsequently, each work W is experimentally ground, and the distances from the surface and back sides of each work W to hydrostatic pads 20, 21 are measured by air gauge sensors Sa ($Sa_1$, $Sa_2$), Sb ($Sb_1$, $Sb_2$), and Sc ($Sc_1$, $Sc_2$). And, after completion of grinding, the work W is taken out of the grinding machine, and the deformation amount and thickness of work W are measured by a proper measuring device. In accordance with the measuring results, the standby position (feeding start position) is changed so that the deformation (bend) of work W becomes 0, followed by grinding the next work W. This is repeated several times in order to obtain work W of which deformation (bend) is nearly 0 and thickness is as specified. This is called ideal work $W_0$. When ideal work $W_0$ is obtained, the distance from work $W_0$ to hydrostatic pads 20, 21 is called ideal distance $L_0$. Thus, the distance from work W to hydrostatic pads 20, 21 becomes ideal distance $L_0$ on completion of grinding, then the feed completing position is the optimum position. The ideal distance $L_0$ is stored in comparator 8*a* of wheel position control unit 8.

C. Grinding Wheel 1, 2 Position Adjustment:

After determination of the optimum position, before grinding the first sheet of work W, grinding wheel 1, 2 is at the optimum standby position (optimum feeding start position), axially returned by a predetermined distance from the optimum value, and grinding of work W is started from this position.

The work W is ground, and at every spark-out, the distance from the opposed supporting surfaces of hydrostatic pads 20, 21 to the work W is measured at three points by work measuring device 7. In wheel position control unit 8, grinding wheels 1, 2 are moved to adjust its tilt or the like in accordance with distance values La, Lb, Lc obtained from the measured distances. The moving adjustment is made after completion of work W grinding, that is, when grinding wheel 1, 2 returns to the standby position after spark-out.

In the initial state, wear of grinding wheels 1, 2 is very slight, and there is almost no defective tilt of the wheel spindles of grinding wheels 1, 2 due to secular change of mechanical parts of the device or external factors such as thermal displacement, and no or little deviation between the actual feed completing position and the optimum position. Accordingly, distance values La, Lb, Lc from the work W to hydrostatic pads 20, 21 are nearly equal to the ideal distance value $L_0$, and the deformation (bend) of work W is less than the specified amount Ls, and both parallelism and flatness are excellent.

(a) Grinding Wheel 1, 2 Axial Position Adjustment:

As the grinding is continued, distance value Lb is $Lb=L_0$, while distance values La and Lc are subjected to gradual change such as La=Lc=L1, L2, L3, . . . Accordingly, the flatness of work W gradually worsens after completion of grinding. This is mainly because the feed completing position grinding wheel 1, 2 is deviated from the optimum position due to one-sided wear of grinding wheel 1, 2. This occurs when distance value La=Lc≠Lb, and the condition is as shown in FIG. 9.

And, when distance values La, Lc exceed the threshold value Ls, wheel position control unit 8 operates to drive the stepping motor 13*a* of wheel feeding device 13 as an axial position adjusting means so that the setting of the feed completing position of grinding wheel 1, 2 is corrected by (Lb−Lc) in axial direction.

As an example, for example, when ideal distance $L_0$ is 0.05 mm, and the measured distance in the initial state shown in FIG. 8 is $La_1=La_2=Lb_1=Lb_2=Lc_1=Lc_2=0.05$ mm, then distance value La $[(La_1-La_2)/2]$=Lb $[(Lb_1-Lb_2)/2]$=Lc $[(Lc_1-Lc_2)/2]=0$.

Figure 9:
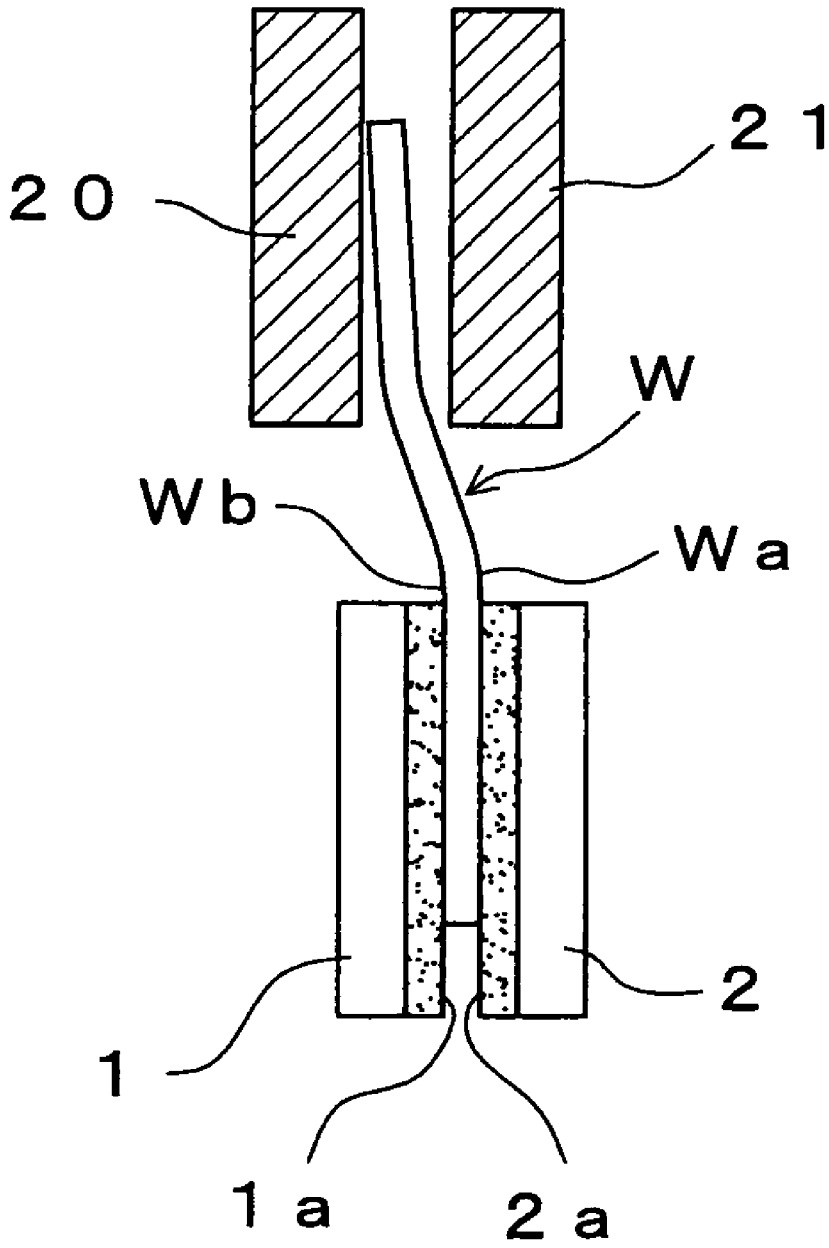
FIG. 9 is a schematic diagram showing the positional relation between the work supported by the hydrostatic pad and the grinding wheel of the surface grinding machine, showing a wearing state of the grinding wheel.

From this initial state, if the measured distance changes from ideal distance $L_0=0.05$ mm to $La_1=Lc_1=0.056$ mm for example, making $La_2=Lc_2=0.044$ mm, then distance value La $[(La_1-La_2)/2]$=Lc $[(Lc_1-Lc_2)/2]=0.006$ mm, and the condition is as shown in FIG. 9.

And, when the distance values La, Lc exceed the threshold value Ls (e.g. 0.05 mm), wheel position control unit 8 operates to drive the stepping motor 13*a* of wheel feeding device 13 as an axial position adjusting means so that the setting of the feed completing position of grinding wheel 1, 2 is axially corrected by (Lb−Lc)=−0.006 mm (that is, grinding wheel spindles 3, 4 are moved 0.006 mm toward the left).

This correction improves the work finishing accuracy (flatness and parallelism).

Further, as the grinding is continued, distance values La, Lc are gradually deviated from ideal distance $L_0$, and therefore, each time the values exceed the threshold value Ls, the setting of the feed completing position of grinding wheel 1, 2 is corrected by (Lb−Lc) in axial direction.

(b) Grinding Wheel 1, 2 Tilting Adjustment:

As the correction (grinding wheel 1, 2 axial position adjustment) in (a) is repeated several times, distance values La, Lc fail to become less than the threshold value Ls even after execution of the correction.

Thermal displacement must be the main cause. That is, grinding wheel spindles 3, 4 are tilted due to thermal displacement or the like, and it takes place in two kinds of patterns shown in FIG. 10 or FIG. 11.

Accordingly, wheel position control unit 8 makes the following adjustment control in accordance with measured distance values La, Lb, Lc measured with these two kinds of tilt of grinding wheels 1, 2 as basic patterns.

Figure 10:
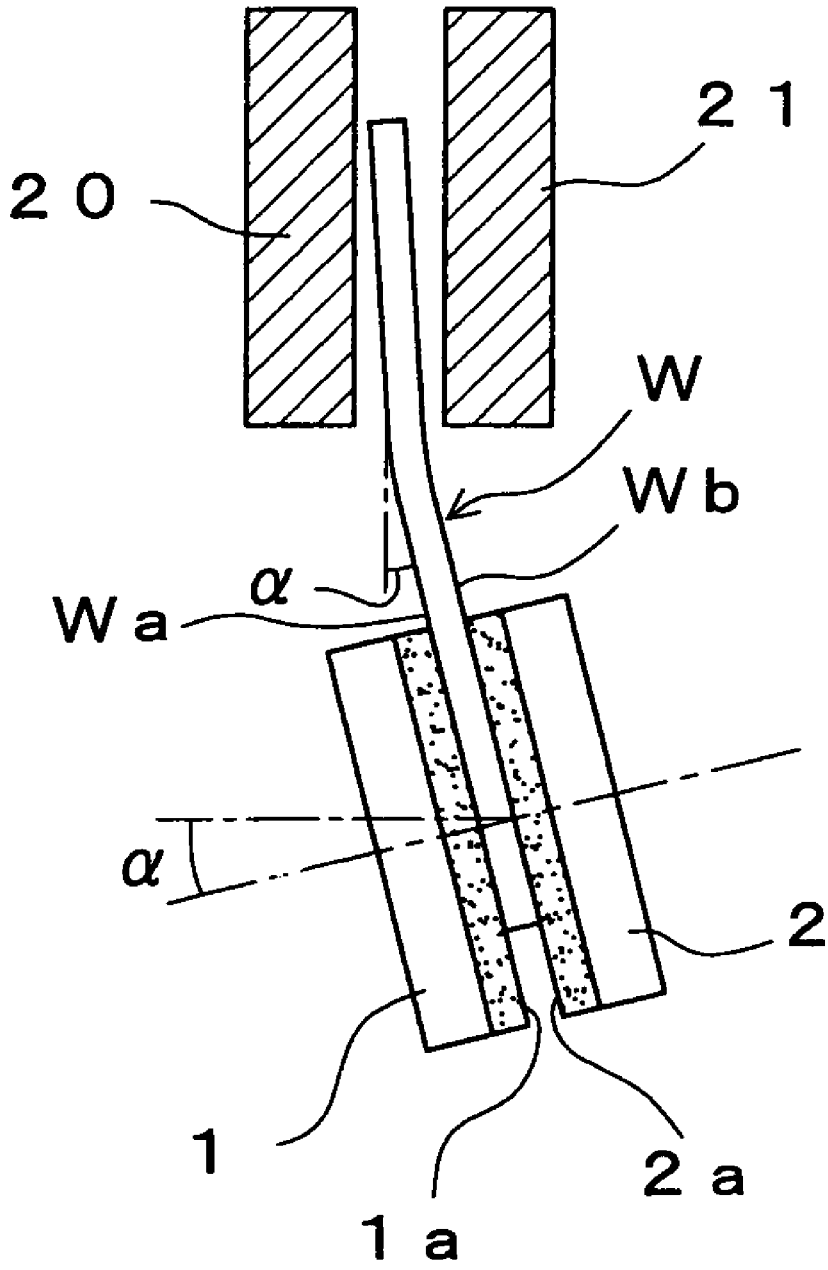
FIG. 10 is a schematic diagram showing the positional relation between the work supported by the hydrostatic pads and the grinding wheel of the surface grinding machine, showing a vertically tilted state of the grinding wheel.

(b-1) Grinding Wheel 1, 2 Vertical Tilting Adjustment:

First, when distance value is La=Lc≠Lb, the pattern is as shown in FIG. 10. That is, in this case, grinding wheels 1, 2 are tilted by angle α in vertical direction to the original axial direction due to the vertical tilt of grinding wheel spindles 3, 4.

Wheel position control unit 8 calculates the adjusting amount for grinding wheel spindles 3, 4 so that the angle α of vertical tilt (bend) of work W calculated from distance values La, Lb, Lc becomes 0°, and rotationally drives the stepping motor 67 of vertical position adjusting member 40 in wheel tilting device 6, 6. Thus, wheel spindle stocks 10, 11 and grinding wheels 1, 2 are vertically tilted to make distance value $La=Lc=Lb=L_0$, thereby obtaining the state shown in FIG. 8.

Figure 11:
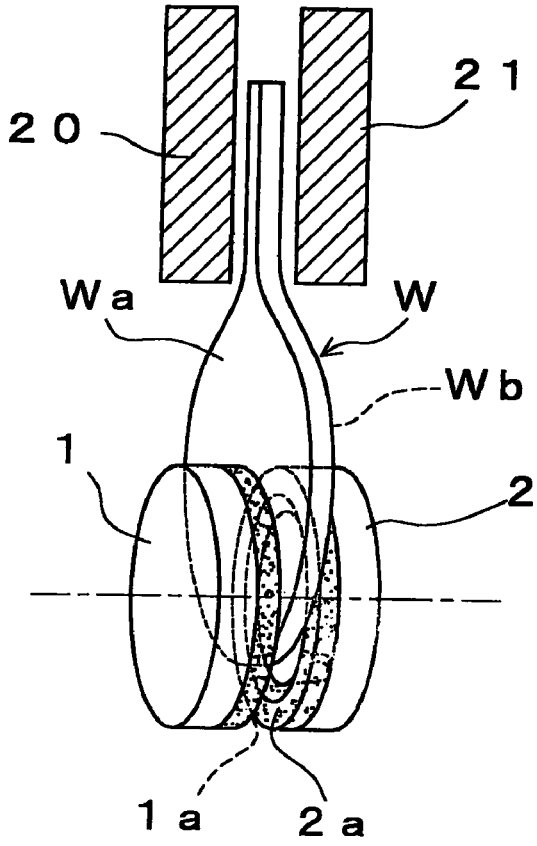
FIG. 11 is a schematic diagram showing the positional relation between the work supported by the hydrostatic pads and the grinding wheel of the surface grinding machine, showing a horizontally tilted state of the grinding wheel.
Figure 11:
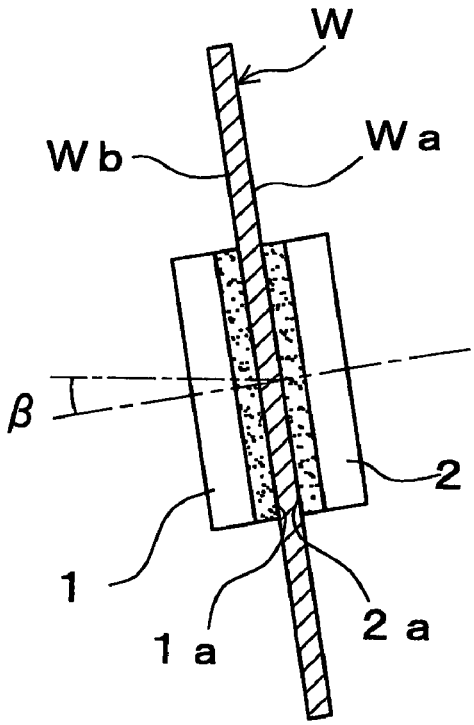

(b-2) Grinding Wheel 1, 2 Horizontal or Horizontal Vertical Tilt Adjustment:

Next, when the distance value is La≠Lc, the pattern is as shown in FIG. 11 or a composite of the pattern shown in FIG. 11 and the pattern shown in FIG. 10. That is, in this case, due to the horizontal tilting of grinding wheel spindles 3, 4, grinding wheels 1, 2 are tilted by angle β in a direction horizontal to the original axial direction, or due to tilting in both vertical and horizontal directions of grinding wheel spindles 3, 4, grinding wheels 1, 2 are tilted by angle β in a direction horizontal to the original axial direction and by angle α in vertical direction as well.

Wheel position control unit 8 first calculates the adjusting amount for grinding wheel spindles 3, 4 so that the angle β of vertical tilt (bend) of work W calculated from distance values La, Lb, Lc becomes 0°, and rotationally drives the stepping motor 77 of horizontal position adjusting unit 41 in wheel tilting device 6, 6. Thus, wheel spindle stocks 10, 11 and grinding wheels 1, 2 are horizontally tilted.

As a result of this correction, in work W to be ground next, the distance value is La=Lc, and also, when $La=Lb=Lc=L_0$, the correction is made as shown in FIG. 8.

On the other hand, if La=Lc≠Lb, the state is as shown in FIG. 10, and therefore, the further correction (grinding wheel 1, 2 vertical tilting adjustment) in (b-1) is made to obtain the state shown in FIG. 8.

In this way, in a both-side grinding machine having the above configuration, work supporting device 5 rotationally supports work W in grinding position by means of main control unit, and paired grinding wheels 1, 2 rotating at a high speed are fed by the predetermined feeding amount from the specified standby position in the axial direction of grinding wheel spindles 3, 4, and then the surface and back Wa, Wb of work W are ground at the same time by the grinding surfaces 1*a*, 2*a* at the end of both grinding wheels 1, 2. Grinding wheels 1, 2 are returned to the standby position after spark-out, during which work W is taken out of work supporting device 3. After that, the procedure is repeated to continuously grind a plurality of work W, W, . . . one by one.

In this case, work measuring device 7 measures the distances from the opposed supporting surfaces of hydrostatic pads 20, 21, reference positions, to the surface and back sides of work W at three points by using air gauge sensors Sa, Sb, Sc at the time of spark-out of grinding wheels 1, 2, and also, work deformation calculating unit 80 detects the deformation amount of work W (axial deformation, vertical bend, horizontal bend) from the results of measurement at three points (distances $La_1$, $Lb_1$, $Lc_1$, $La_2$, $Lb_2$, $Lc_2$).

And, in case the deformation amounts (distance values La, Lb, Lc) exceed the specified value (threshold), as described above, wheel position control unit 8 makes driving control of wheel tilting device 6, 6 and wheel feeding device 13, 13 in accordance with the deformation amounts La, Lb, Lc so that work W is flat without deformation when the feeding operation of grinding wheels 1, 2 is completed, thereby adjusting the movement of grinding wheels 1, 2. Thus, grinding wheels 1, 2 may always keep their correct positions (correct axial position and tilt), it is possible to obtain work which is free from bending and excellent in parallelism and flatness.

Embodiment 2

In embodiment 1, the moving adjustment of grinding wheels 1, 2 is made after completion of grinding of work W, but in this embodiment, the moving adjustment of grinding wheels 1, 2 is performed during grinding of work W as described in the following.

That is, in this embodiment, same as in the case of embodiment 1, the ideal distance value $L_0$ for distance values La, Lb, Lc is stored in the initial state, and the tilt of grinding wheel 1, 2 is corrected in accordance with the distance values La, Lb, Lc while monitoring each distance value La, Lb, Lc at the time of spark-out of grinding wheel 1, 2.

That is, when the distance value is La≠Lc, wheel position control unit 8 first makes the moving correction of horizontal tilt of grinding wheel spindles 3, 4 (in case La=Lc from the beginning, the moving correction is not needed) until the distance value La=Lc.

Next, the vertical tilt of grinding wheels 3, 4 is corrected to make it as shown in FIG. 8 until the distance value $La=Lb=L_0$.

In case the correction of horizontal tilt of grinding wheels 3, 4 is not effective, as shown in FIG. 9, grinding wheel spindles 3, 4 are axially moved and adjusted to make the distance value $La=Lb=Lc=L_0$, as shown in FIG. 8.

The other configurations and actions are same as in embodiment 1.

The embodiments described above are preferable embodiments of the present invention, and the present invention is not limited to these. It is possible to change the design in various ways within the scope of the embodiment. For example, it is possible to make modification as described in the following.

(1) In the embodiment shown, three air gauge sensors Sa, Sb, Sc are respectively disposed on the supporting surfaces of hydrostatic pads 20, 21. That is, three sets of paired air gauge sensors are disposed, and the distances to the surface and back Wa, Wb of work W therefrom are measured at three points, and the paired gauge sensors are preferable to be disposed at three portions at least, and it is possible to increase the number of sensors. In this case, one set of paired air gauge sensors is desirable to be disposed on the center line in the vertical direction of work W, and also, the remaining sets are desirable to be disposed at positions symmetrical to the center line, and therefore, it is desirable to dispose the sensors at odd-numbered portions of five at least.

For example, when five air gauge sensors Sa, Sb, Sc, Sd, Se are respectively disposed on the supporting surfaces of hydrostatic pads 20, 21, as shown in FIG. 4 (*c*), one set of air nozzles 30A to 30E of air gauge sensors Sa to Se, that is, the set of paired air nozzles $30C_1$, $30C_2$ is disposed so as to be positioned on the vertical center line that is a diametric line of work W (and grinding wheel 1, 2), and at the same time, the remaining sets of air nozzles, that is, a set of air nozzles $30A_1$, $30A_2$, a set of air nozzles $30B_1$, $30B_2$, a set of air nozzles $30D_1$, $30D_2$, and a set of air nozzles $30E_1$, $30E_2$ are respectively disposed at positions symmetrical to the vertical center line. Also, the sets of these paired air nozzles are disposed at equal intervals along the circumference of grinding wheels 1, 2 [the angles (central angles) made by the air nozzles and the center O of grinding wheels 1, 2 are equal].

(2) Work supporting device 5 of the embodiment shown employs hydraulic support device 17 which supports work W in non-contact state with right and left paired hydrostatic pads 20, 21 as an axial position supporting means for positioning and supporting the work W in axial direction, but it is possible to employ, for example, a roller supporting means using conventionally-known supporting rollers or the like as is disclosed in Japanese Laid-open Patent H10-128646 or Japanese Laid-open Patent H10-175144.

(3) As to distance sensors Sa, Sb, Sc, it is also possible to employ other non-contact type sensor such as a static capacity type sensor and laser device besides the air gauge sensor of the embodiment shown.

(4) In the embodiment shown, when distance values La, Lb, Lc exceed the threshold value Ls, wheel position control unit 8 automatically corrects the position of grinding wheels 1, 2, but the position can also be corrected by manual operation instead of the operation of wheel position control unit 8 or in combination therewith.

In the case of manual operation, a warning signal is emitted by an alarm or the like, and the operator stops the machine in accordance with the signal, and manually adjusts the grinding wheels 1, 2 to the initial state shown in FIG. 8 and then resumes the operation.

Specifically, in the case of wheel tilting device 6, with power supply to the stepping motor 67, 77 discontinued and output shafts 67*a*, 77*a* freed, a hand-operated tool such as a wrench is fitted to square pole 66*e*, 77*e* to rotate worm gear 66, 76, and thereby, the tilt of wheel spindle stock 10, 11 can be adjusted by manual operation.

(5) In the embodiment shown, it is configured in that the feeding operation of grinding wheel 1, 2 stops after feeding by a previously set specific amount from the predetermined standby position (feeding start position) by means of wheel feeding device 13 (then the stop position is the feed completing position), and is returned to the standby position after spark-out, and in the axial position adjustment of grinding wheels 1, 2, the standby position is adjusted, that is, the feeding amount is constant and the standby position is variable.

On the other hand, it is also preferable to be configured in that the feeding amount is variable, and the standby position is constant, and in the axial position adjustment of grinding wheels 1, 2, the feeding amount is changed and adjusted.

(6) Further, the both-side grinding machine of the embodiment shown is a horizontal opposed double-disk surface grinding machine, but it is of course possible to apply the present invention to other grinding machines.

(7) Also, in the embodiment shown, the disc work to be ground is circular in shape, but the present invention is able to grind an annular work having a circular hole in the center or a so-called doughnut-like work.

In this case, work W is supported in such manner that the outer periphery thereof intersects the outer periphery of grinding surface 1*a*, 2*a* of grinding wheel 1, 2, and a part of the central hole of work W is positioned in grinding surface 1*a*, 2*a*, and thus, the surface and back Wa, Wb of work W axially and outwardly protruded from the outer peripheries of grinding surfaces 1*a*, 2*a* are rotationally supported by work supporting device 5.

INDUSTRIAL APPLICABILITY

As described above, according to the present invention, the work is rotationally supported and a pair of grinding wheels rotating at a high speed are fed in the axial direction of the grinding wheel spindle in order to simultaneously grind the surface and back sides of the work with the grinding surfaces of both grinding wheels. At the time, when the operation of the grinding wheels is completed, the distances from the reference position to the surface and back sides of the work are measured at three points at least by using a non-contact type distance sensor, and from the results of measurement at three points at least, the deformation amount of the work is detected, and in case the calculated deformation amount exceeds the specified value, the grinding wheel is moved and adjusted in accordance with the amount of deformation so that the work is flat without deformation when the feeding operation of the grinding wheels is completed. Accordingly, it is possible to obtain the effects as mentioned in the following and to make the work excellent in flatness and parallelism without bending.

(1) The distances from the reference position to the surface and back sides of the work are measured at three points at least, and thereby, it is possible to detect bending right and left in horizontal direction or bending in vertical direction of the work.

(2) The grinding wheel spindle is tilt-controlled, and the position of the grinding wheel can be properly controlled, thereby eliminating NG work.

(3) The work can be ground, automatically adjusting the grinding wheel to an appropriate position, and the accuracy of flatness can be maintained.

The invention claimed is:

1. A both-side grinding method for thin disc work in which the thin disc work is rotationally supported and a pair of grinding wheels rotating at a high speed are fed in the axial direction of its grinding wheel spindle in order to simultaneously grind both surface and back sides of the work by grinding surfaces of the grinding wheels, comprising the steps of:

rotationally supporting the work by a work supporting means in a state such that the work is between the grinding surfaces of the paired grinding wheels and the surface and back of the work are opposed to the grinding surfaces;

measuring distances from a predetermined position to the surface and back of the work at three points at least by using a non-contact type distance sensor when the feeding operation of the grinding wheels is completed;

detecting the amount of deformation of the work from the results of measurement at the three points at least; and in case the calculated amount of deformation exceeds a specified value, making moving adjustment of the grinding wheels in accordance with the amount of deformation so that the work is flat without deformation when the feeding operation of the grinding wheels is completed, wherein the work supporting means comprises a hydrostatic supporting means which supports the surface and back of the work with hydrostatic fluid in a non-contact state, and wherein the hydrostatic supporting means is provided with the at least three non-contact type distance sensors measuring the distances at the at least three points.

2. The both-side grinding method for thin disc work of claim 1, wherein in a state that the work is disposed so that the outer periphery of the work intersects the outer periphery of the grinding surface of the grinding wheel as viewed opposite to the surface and back of the work, the work surface and back portions protruded radially outwardly from the outer periphery of the grinding surface are rotationally supported.

3. The both-side grinding method for thin disc work of claim 2, wherein the distance sensors are disposed in pairs at positions opposing to each other with the work disposed therebetween, and sets of these paired distance sensors are disposed at three or more odd-numbered portions close to the outer peripheries of grinding surfaces of the grinding wheels, and as viewed opposite to the surface and back of the work, one set of the distance sensors is disposed on a diametric line of the work, and the remaining sets of distance sensors are respectively disposed at positions symmetrical to the diametric line, and sets of these distance sensors are disposed at equal intervals along the circumference of the grinding wheel.

4. The both-side grinding method for thin disc work of claim 1, wherein the distance measurement by the distance sensor is performed at spark-out of the grinding wheel.

5. The both-side grinding method for thin disc work of claim 1, wherein the moving adjustment of the grinding wheel is performed after completion of grinding of the work.

6. The both-side grinding method for thin disc work of claim 1, wherein the moving adjustment of the grinding wheel is performed during grinding of the work.

7. A both-side grinding machine for thin disc work in which the thin disc work is rotationally supported and a pair of grinding wheels rotating at a high speed are fed in the axial direction of the grinding wheel spindle in order to simultaneously grind both surface and back sides of the work by grinding surfaces of the grinding wheels, comprising:

a pair of grinding wheels disposed so that the grinding surfaces at the ends of the grinding wheels are opposed to each other a work supporting means which rotationally supports the work in a state such that the work is between the grinding surfaces of the paired grinding wheels and the surface and back of the work are opposed to the grinding surfaces;

a grinding wheel adjusting means for adjusting the position of the grinding wheel;

a work measuring means which measures distances from a predetermined reference position to the surface and back of the work rotationally supported by the work supporting means at three points at least when the feeding operation of the grinding wheels is completed, and calculates the amount of deformation of the work being rotationally supported from the results of measurement at the three points, and a wheel position control means for controlling the grinding wheel adjusting means in accordance with the measurement results of the work measuring means, wherein the work supporting means comprises a hydrostatic supporting means which supports the surface and back of the work with hydrostatic fluid in a non-contact state, and wherein the work measuring means comprises at least three non-contact type distance sensors for measuring the distances at the at least three points, and the at least three non-contact type distance sensors are provided on the hydrostatic supporting means.

8. The both-side grinding machine for thin disc work of claim 7, wherein the work supporting means is configured in that in a state that the work is disposed so that the outer periphery of the work intersects the outer periphery of the grinding surface of the grinding wheel as viewed opposite to the surface and back of the work, the work surface and back portions protruded radially outwardly from the outer periphery of the grinding surface are rotationally supported.

9. The both-side grinding machine for thin disc work of claim 7, wherein the work measuring means comprises at least three pairs of the non-contact type distance sensors for measuring distances from a predetermined reference position to the surface and back of the work, and a work deformation calculating means for calculating the amount of deformation of the work from the detection results of these three pairs of distance sensors.

10. The both-side grinding machine for thin disc work of claim 9, wherein the distance sensors are disposed in pairs at positions opposing to each other with the work disposed therebetween, and sets of these paired distance sensors are disposed at three or more odd-numbered portions close to the outer peripheries of grinding surfaces of the grinding wheels, and as viewed opposite to the surface and back of the work, one set of the distance sensors is disposed on a diametric line of the work, and the remaining sets of distance sensors are respectively disposed at positions symmetrical to the diametric line, and sets of the distance sensors are disposed at equal intervals along the circumference of the grinding wheel.

11. The both-side grinding machine for thin disc work of claim 9, wherein the work supporting means comprises a hydrostatic supporting means for supporting the surface and back of the work in a non-contact state, and is configured in that the hydrostatic pad of the hydrostatic supporting means is provided with the distance sensor of the work measuring means, and the distance sensor measures distances from the hydrostatic pad being the reference position to the surface and back of the work.

12. The both-side grinding machine for thin disc work of claim 7, wherein the grinding wheel adjusting means comprises an axial position adjusting means for adjusting the axial position of the grinding wheel, a vertical position adjusting means for vertically adjusting the tilt of the grinding wheel about the horizontal axis, and a horizontal position adjusting means for horizontally adjusting the tilt of the grinding wheel about the vertical axis.

13. The both-side grinding machine for thin disc work of claim 12, wherein the wheel position control means is configured in that when the amount of deformation of the work measured by the work measuring means exceeds the specified value, the axial position adjusting means, vertical position adjusting means, and horizontal position adjusting means of the grinding wheel adjusting means are controlled in accordance with the amount of deformation so that the work is flat without deformation when the feeding operation of the grinding wheels is completed.

14. The both-side grinding machine for thin disc work of claim 7, wherein the moving adjustment of the grinding wheel is performed after completion of grinding of the work.

15. The both-side grinding machine for thin disc work of claim 7, wherein the distance measurement by the work measuring means is performed at spark-out of the grinding wheel.

16. The both-side grinding machine for thin disc work of claim 7, wherein the grinding wheel position adjustment by the wheel position adjusting means is performed during grinding of the work.

17. The both-side grinding machine for thin disc work of claim 7, wherein the work supporting means includes at least one hydrostatic pad having at least three air gauge sensors, a respective one of the at least three air gauges measuring a respective one of the distances at the at least three points.

* * * * *